US006461144B1

(12) United States Patent
Gutmark et al.

(10) Patent No.: US 6,461,144 B1
(45) Date of Patent: Oct. 8, 2002

(54) METHOD OF CONTROLLING THERMOACOUSTIC VIBRATIONS IN A COMBUSTION SYSTEM, AND COMBUSTION SYSTEM

(75) Inventors: Ephraim Gutmark, Baton Rouge, LA (US); Christian Oliver Paschereit, Baden; Wolfgang Weisenstein, Remetschwil, both of (CH)

(73) Assignee: Alstom (Switzerland) Ltd, Baden (CH)

( * ) Notice: Subject to any disclaimer, the term of this patent is extended or adjusted under 35 U.S.C. 154(b) by 0 days.

(21) Appl. No.: 09/565,553

(22) Filed: May 5, 2000

(30) Foreign Application Priority Data

May 7, 1999 (DE) ..... 199 28 226

(51) Int. Cl.[7] ..... G10K 11/178

(52) U.S. Cl. ..... 431/2; 431/114; 60/725; 381/71.2

(58) Field of Search ..... 431/2, 18, 19, 431/75, 76, 114; 60/725; 381/71.1, 71.2, 71.5, 71.8, 71.9

(56) References Cited

U.S. PATENT DOCUMENTS

| | | | | |
|---|---|---|---|---|
| 2,043,416 A | * | 6/1936 | Lueg | 381/71.1 |
| 3,826,870 A | * | 7/1974 | Wurm et al. | 381/71.5 |
| 3,936,606 A | * | 2/1976 | Wanke | 381/71.5 |
| 4,044,203 A | * | 8/1977 | Swinbanks | 60/725 |
| 4,473,906 A | | 9/1984 | Warnaka et al. | |
| 4,557,106 A | | 12/1985 | Ffowcs Williams et al. | |
| 5,145,355 A | | 9/1992 | Poinsot et al. | |
| 5,347,585 A | | 9/1994 | Taki et al. | |
| 5,428,951 A | | 7/1995 | Wilson et al. | |

FOREIGN PATENT DOCUMENTS

| | | |
|---|---|---|
| DE | 41 30 559 | 3/1993 |
| DE | 31 44 052 | 7/1993 |
| EP | 0 918 152 | 5/1999 |

OTHER PUBLICATIONS

Paschereit et al., "Structure and Control of Thermoacoustic Instabilities in a Gas–Turbine Combustor", 36th Aerospace Science Meeting and Exhibit, Reno, Nevada, Jan. 12–15, 1998.

* cited by examiner

*Primary Examiner*—Sara Clarke
(74) *Attorney, Agent, or Firm*—Burns, Doane, Swecker & Mathis, L.L.P.

(57) ABSTRACT

In a method of suppressing or controlling thermoacoustic vibrations which develop in a combustion system having a burner working in a combustion chamber due to the formation of coherent or vortex structures and a periodic heat release associated therewith, in which method the vibrations are detected in a closed control loop and acoustic vibrations of a certain amplitude and phase are generated as a function of the detected vibrations and induced in the combustion system, improved suppression is achieved in that, within the control loop, the amplitude of the generated acoustic vibrations is selected to be proportional to the amplitude of the detected vibrations.

11 Claims, 3 Drawing Sheets

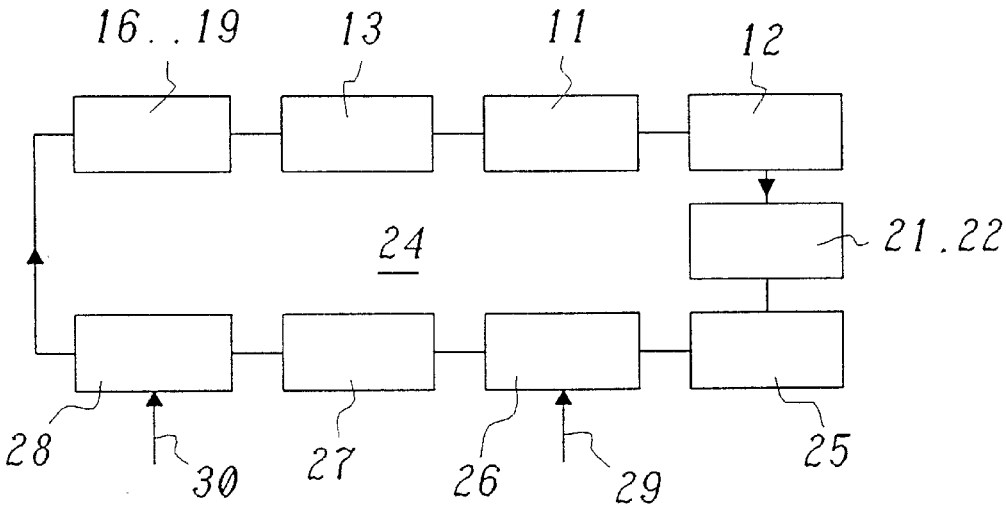
Fig. 2
Fig. 3
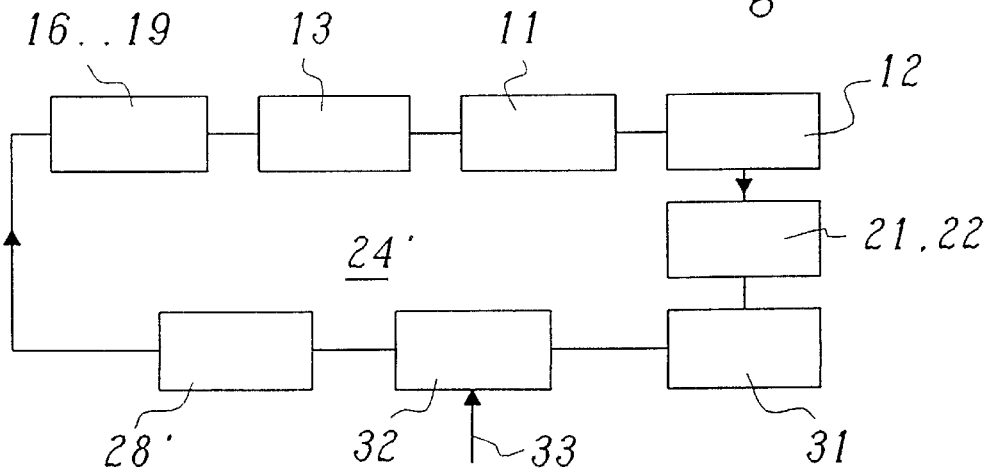

METHOD OF CONTROLLING THERMOACOUSTIC VIBRATIONS IN A COMBUSTION SYSTEM, AND COMBUSTION SYSTEM

FIELD OF THE INVENTION

The present invention relates to the field of combustion technology, as is of importance, in particular, for gas turbines. The invention relates to a method of suppressing or controlling thermoacoustic vibrations in a combustion system.

The invention also relates to a combustion system for carrying out the above method.

BACKGROUND OF THE INVENTION

Such a method or combustion system has been disclosed, for example, by the article by Paschereit, C. O., Gutmark, E., and Weisenstein, W., "Structure and Control of Thermoacoustic Instabilities in a Gas-Turbine Combustor", 36$^{th}$ AIAA Aerospace Science Meeting and Exhibit, Reno, Nev., Jan. 12–15, 1998.

Thermoacoustic vibrations represent a risk to every type of combustion application or system. They lead to pressure fluctuations of high amplitude and to a restriction in the operating range and may increase the undesirable pollutant emissions. This applies in particular to combustion systems having low acoustic damping, as is normally the case in gas turbines. In order to permit a high power conversion with regard to pulsations and emissions over a wide operating range, active control or suppression of the combustion vibrations may be necessary.

Various active control systems have already been proposed in the past, these control systems working according to the principle of the "antisound", i.e. the thermoacoustic vibrations are detected, displaced in phase by 180 degrees and induced in the system in a correspondingly amplified form in order to then lead to an extinction during superimposition with the thermoacoustic vibrations on account of the phase opposition. The antisound solutions have proved to be useful in combustion systems of low output. However, in combustion systems of high output with correspondingly pronounced pressure fluctuations, it becomes increasingly difficult to generate and induce corresponding acoustic vibrations at a justifiable cost.

In order to permit an active control even at high outputs, it has therefore been proposed to either modulate the burner flame itself via the fuel feed as a function of the detected instabilities (U.S. Pat. No. 5,145,355) or to introduce a vibration generator in the form of an auxiliary burner operating in a pulsating manner (U.S. Pat. No. 5,428,951). The desired acoustic vibrations of high power can thus be generated in both cases via deliberately generated fluctuations in the heat release. A disadvantage in this context, however, is that this type of vibration generation requires considerable intervention in the combustion system and therefore cannot readily be retrofitted, for example, in existing designs. In addition, such a system, on account of the complexity of the combustion actions coming into play in the process, can be influenced and controlled in a deliberate and stable manner only with difficulty over a larger operating range.

In the publication mentioned at the beginning, an active control of the thermoacoustic vibrations has now been proposed, and this active control is not based on the extinction of sound but intervenes in the development of the vibrations and can be described as follows: coherent structures are of crucial importance during mixing actions between air and fuel. The dynamics of these structures therefore influence the combustion and thus the heat release. Control of the combustion instabilities is possible by influencing the shear layer between the fresh-gas mixture and the recirculating exhaust gas. One possibility of influencing the shear layer is the acoustic excitation described in the publication mentioned at the beginning. The acoustic excitation permits suppression of the combustion-driven vibrations by preventing the formation of coherent structures. Periodic heat release and thus the basis for the occurrence of thermoacoustic vibrations are prevented by preventing the development of vortex structures at the burner outlet.

Unlike the principle of the antisound, in which an existing sound field is extinguished by introducing a phase-shifted sound field of the same energy, this method is based on directly influencing the shear layer. This direct influencing of the shear layer has the advantage that the disturbances which are introduced from outside are amplified in the shear layer itself, and therefore less energy is required for generating the disturbances than in the case of the direct extinction of a sound field by antisound. In this case, the shear layer may be excited both downstream and upstream of the burner. Since only low power is necessary, the sound energy may be introduced into the flow, for example, by acoustic drivers, in particular loudspeakers or the like. By selection of the correct phase difference between pulsation and acoustic excitation signal, the coherence of the developing instability waves can be disturbed and the pulsation amplitudes can be reduced.

An exemplary combustion system as has been used in the publication mentioned at the beginning and as is also suitable for the present invention is reproduced schematically in FIG. 1. The combustion system 10 comprises a (swirl-stabilized) burner 11, which works in a combustion chamber 12. The burner 11 receives the requisite combustion air via an air feed 13. A corresponding fuel feed 14 is provided for the fuel supply. Sensors 20–22, which may be arranged on the air feed (sensors 20) and/or on the combustion chamber (sensors 21, 22), are provided for detecting the thermoacoustic vibrations which develop in the region of the flame 15. The sensors 20–22 may be designed for the direct detection of the pressure fluctuations or vibrations as (water-cooled) microphones or other dynamic pressure transducers. However, the sensors 20–22 may also be designed entirely or partly as optical sensors, with which the fluctuations in the heat release which are directly associated with the thermoacoustic vibrations may be detected directly via the chemiluminescence, e.g. of the OH molecules.

The sensors 20–22 are connected to a controller 23, which on the output side activates various loudspeakers 16–19, which are arranged symmetrically to the axis of the combustion system 10 alternatively in the region of the air feed 13 and/or the combustion chamber 12. In accordance with the controller 23, the loudspeakers 16–19 generate acoustic vibrations, which are then induced in the combustion system 10 and influence the described shear layers there. The combustion system 10 according to the prior art with the sensors 20–22 and the loudspeakers 16–19—if the vibrations are detected at the combustion chamber 12—forms the closed control loop 24 shown in FIG. 2. The vibrations in the combustion chamber 12 which are detected by the sensors 21 and/or 22 are filtered in a following filter 25 and if need be amplified and are then shifted in phase by a desired amount by means of a phase shifter 26 with predeterminable phase setting 29. The phase-shifted signal then triggers a signal generator 27, the output signal of which is amplified in a power amplifier 28 with predeterminable amplitude setting 30 and is used to activate the loudspeakers 16–19. With this known control, in which the acoustic vibrations are generated synthetically and the amplitude of these vibrations is firmly set, suppression (attenuation) of the combustion-driven vibrations by up to 6 dB has already been achieved in the system used.

However, it would also be desirable to achieve even better suppression with an arrangement according to FIG. 1.

SUMMARY OF THE INVENTION

The object of the invention is therefore to specify a method of acoustically controlling thermoacoustic vibrations, which, while using the principle of the acoustic excitation of the shear layer, permits markedly improved suppression, and to specify a combustion system for carrying out such a method.

An aspect of the invention includes providing proportional control within the closed control loop which is formed by the combustion system with the sensors and the acoustic excitation means (e.g. loudspeakers), i.e., in modulating the amplitude of the generated acoustic vibrations directly in proportion to the amplitude of the detected vibrations. The proportional control results in surprising values for the suppression, which may be up to 20 dB in a system according to FIG. 1.

A preferred embodiment of the method according to the invention is characterized in that, to detect the thermoacoustic vibrations, either the pressure fluctuations associated therewith are acoustically measured or the fluctuations in the heat release which are associated therewith are optically measured, in which case, to optically measure the fluctuations in the heat release, in particular the fluctuations in the chemiluminescence of the OH molecules are measured.

Another preferred embodiment of the method according to the invention is characterized in that loudspeakers, which are acoustically coupled to the combustion system, are used in order to generate the acoustic vibrations.

In a preferred embodiment, the sensors used in the combustion system according to the invention may be designed either as pressure sensors, in particular as a microphone, recording pressure fluctuations or as optical sensors for measuring the chemiluminescence.

BRIEF DESCRIPTION OF THE DRAWINGS

The invention is to be explained in more detail below with reference to exemplary embodiments in connection with the drawing, in which:

FIG. 2 shows the control scheme, disclosed by the prior art, of the system according to FIG. 1;

FIG. 3 shows a preferred exemplary embodiment of a control scheme for the system according to FIG. 1, as used in the method according to the invention.

DETAILED DESCRIPTION OF THE INVENTION

Figure 1:
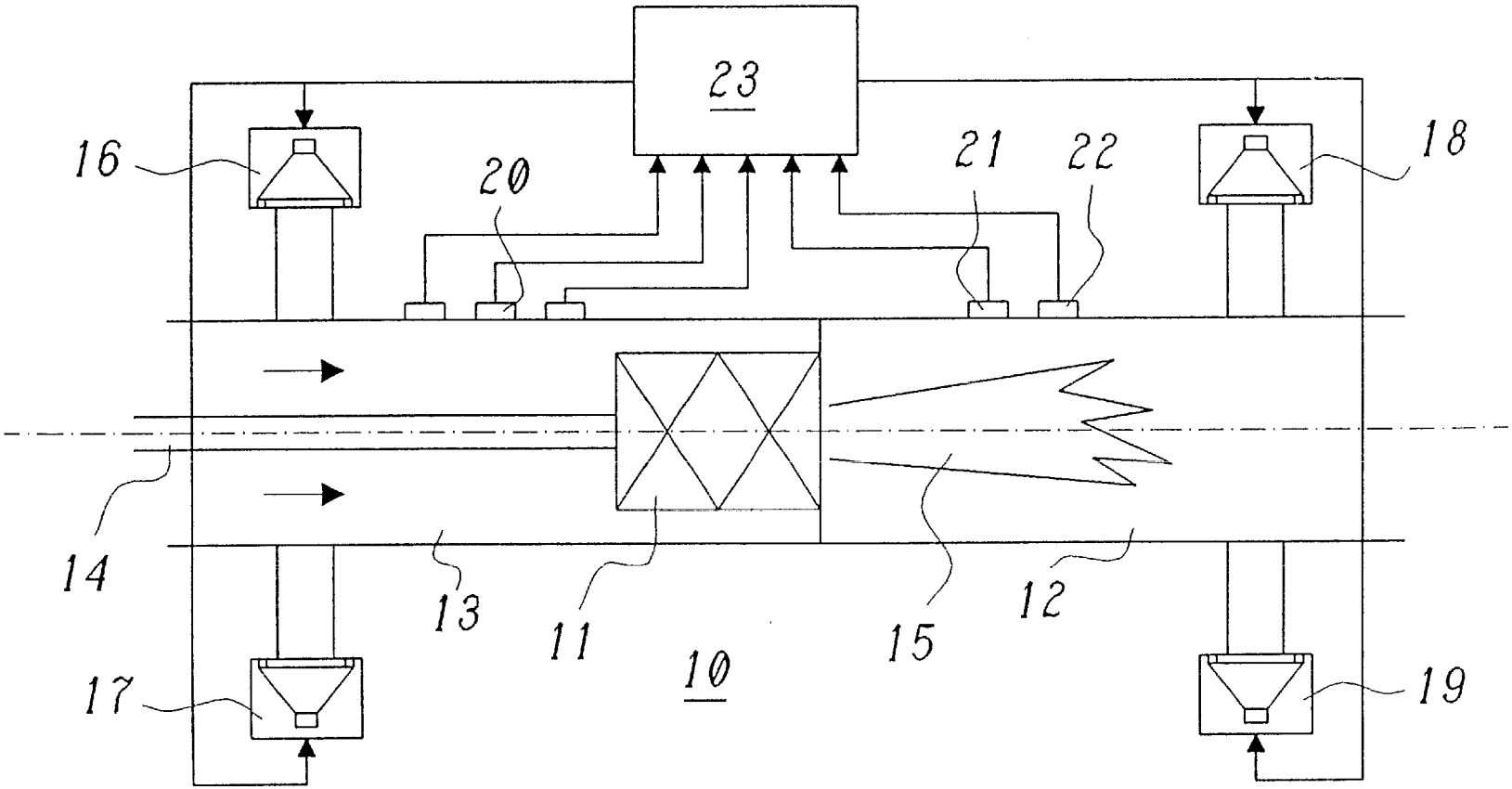
FIG. 1 shows the schematic representation of a combustion system with acoustic control of the thermoacoustic vibrations according to the prior art, as may also be used, for example, to realize the present invention.

Reproduced in FIG. 3 is a preferred exemplary embodiment of a control scheme which may be used in a combustion system according to FIG. 1 within the scope of the invention instead of the control scheme (FIG. 2) disclosed by the prior art in order to obtain improved suppression of the thermoacoustic vibrations. In the closed control loop with proportional control, unlike FIG. 2, the detection signals emitted by the sensors 21, 22 and characteristic of the thermoacoustic vibrations are transmitted to a proportional controller 31, which amplifies the signals and delays them by a predetermined time interval. In this case, the delay—which corresponds to the phase shift in FIG. 2—may be effected directly in the proportional controller 31 or, as shown in FIG. 3, in a downstream delay circuit 32 with delay time setting 33. The preamplified, delayed signal is then transmitted directly to the input of a power amplifier 28', which amplifies it to the power level required for the activation of the loudspeakers 16–19. The proportional control causes the amplitude of the acoustic vibrations generated to increase and fall in proportion to the amplitude of the combustion vibrations detected. This direct interlinking of the two vibrations in terms of control now surprisingly leads to substantially better suppression of the combustion vibrations.

Figure 4:
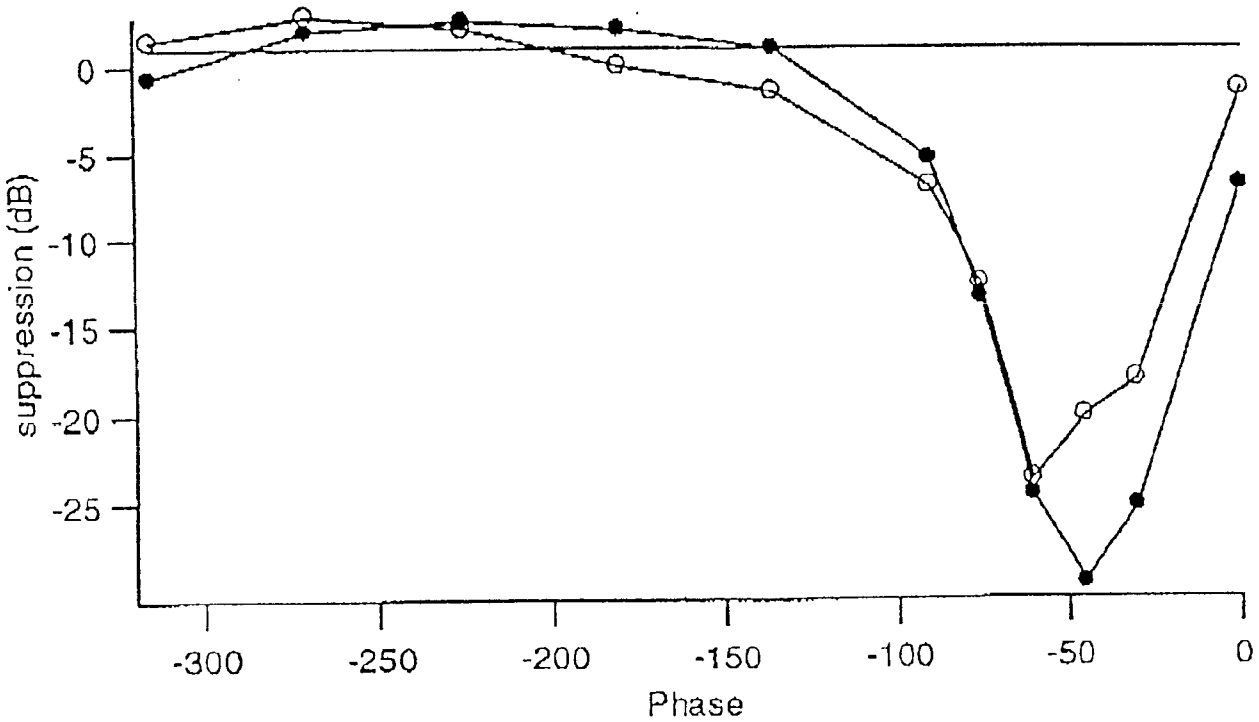
FIG. 4 shows exemplary measuring curves which show the suppression of a pressure vibration in the 100 Hz range in a system according to FIG. 1 with a control scheme according to FIG. 3.

Plotted in FIG. 4 are exemplary measuring results which show the suppression (in dB) of a pressure vibration in the 100 Hz range in a combustion system according to FIG. 1 with a proportional control according to FIG. 3. Shown in this case are the standardized amplitudes as a function of the phase shift (in degrees) between the detected and generated vibrations for the acoustic detection by means of microphone (open circles) and the optical detection via OH chemiluminescence (solid circles). It can be seen that the maximum suppression of more than 20 dB, approximately the same in both cases, results at a phase shift of about 50 degrees.

It goes without saying that the requisite optimum time delay or phase shift depends on the respective combustion system. It is important in each case that the acoustic vibrations can be generated and induced with a power which is several decimal powers smaller than the thermal output of the combustion system. The acoustic excitation means (loudspeakers 16–19)—if the combustion system 10 is the combustion system of a gas turbine—are required to withstand the preheating temperatures of about 400° C. which are normal in gas turbines. Furthermore, they should be able to deliver about 0.001 % of the thermal output per burner 11 (in the case of a plurality of burners) to the respective gas (air or fresh mixture during excitation upstream of the burner 11; exhaust gas during excitation downstream of the burner 11).

What is claimed is:

1. A method of suppressing or controlling thermoacoustic vibrations which develop in a combustion system having a burner working in a combustion chamber due to a formation of coherent or vortex structures and a periodic heat release associated therewith, the method comprising the steps of:

detecting vibrations in a closed control loop;

generating and inducing acoustic vibrations of an amplitude and phase in the combustion system as a function of the detected vibrations;

wherein the amplitude of the generated acoustic vibrations is selected to be proportional to the amplitude of the detected vibrations, and wherein the step of generating and inducing acoustic vibrations comprises generating and inducing acoustic vibrations with a power which is smaller than the thermal output of the combustion system.

2. The method as claimed in claim 1, further comprising:

measuring pressure fluctuation to detect the thermoacoustic vibrations.

3. The method as claimed in claim 1, further comprising:

optically measuring fluctuations in heat release to detect the thermoacoustic vibrations.

4. The method as claimed in claim 3, wherein the step of optically measuring comprises optically measuring fluctuations in chemiluminescence of OH molecules.

5. The method as claimed in claim 1, wherein the step of generating and inducing acoustic vibrations comprises generating and inducing using loudspeakers acoustically coupled to the combustion system.

6. A combustion system useful for suppressing or controlling thermoacoustic vibrations which develop in the combustion system, the combustion system comprising:

a burner;

a combustion chamber;

an air feed for feeding combustion air to the burner;

at least one sensor for detecting thermoacoustic vibrations;

means for generating and inducing acoustic vibrations to create an excitation of a shear layer in the combustion system, wherein the at least one sensor and the means for generating and inducing the acoustic vibrations are arranged in a closed control loop;

a proportional controller in the control loop between the at least one sensor and the means for generating and inducing the acoustic vibrations; and means for adjustable time delay of the control signal in the control loop upstream of the means for generating and inducing the acoustic vibrations.

7. The combustion system as claimed in claim 6, wherein the at least one sensor comprises a pressure sensor for recording pressure fluctuations.

8. The combustion system as claimed in claim 6, wherein the at least one sensor comprises an optical sensor for measuring chemiluminescence.

9. The combustion system as claimed in claim 6, wherein the means for generating and inducing the acoustic vibrations comprises loudspeakers.

10. The combustion system as claimed in claim 9, further comprising a power amplifier within the control loop downstream of the proportional controller, the power amplifier activating the loudspeakers.

11. A combustion system useful for suppressing or controlling thermoacoustic vibrations which develop in the combustion system, the combustion system comprising:

a burner;

a combustion chamber;

an air feed for feeding combustion air to the burner;

at least one sensor for detecting thermoacoustic vibrations;

means for generating and inducing acoustic vibrations in the combustion system, wherein the at least one sensor and the means for generating and inducing the acoustic vibrations are arranged in a closed control loop;

a proportional controller in the control loop between the at least one sensor and the means for generating and inducing the acoustic vibrations;

a power amplifier within the control loop downstream of the proportional controller, the power amplifier activating the means for generating and inducing acoustic vibrations.

* * * * *